US006709348B1

(12) United States Patent
Lemons et al.

(10) Patent No.: US 6,709,348 B1
(45) Date of Patent: Mar. 23, 2004

(54) TWO PIECE DISTANCE GOLF BALL

(75) Inventors: Lane D. Lemons, Easley, SC (US); Matthew B. Stanczak, Westminster, SC (US)

(73) Assignee: Dunlop Sports, Westminster, SC (US)

( * ) Notice: Subject to any disclaimer, the term of this patent is extended or adjusted under 35 U.S.C. 154(b) by 0 days.

(21) Appl. No.: 09/743,304

(22) PCT Filed: Jul. 9, 1999

(86) PCT No.: PCT/US99/15424

§ 371 (c)(1),
(2), (4) Date: Jan. 8, 2001

(87) PCT Pub. No.: WO00/02626

PCT Pub. Date: Jan. 20, 2000

Related U.S. Application Data

(60) Provisional application No. 60/092,477, filed on Jul. 10, 1998.

(51) Int. Cl.[7] ..... A63B 37/12
(52) U.S. Cl. ..... 473/378; 473/382
(58) Field of Search ..... 473/377–384

(56) References Cited

U.S. PATENT DOCUMENTS

| | | | | | |
|---|---|---|---|---|---|
| 4,560,168 | A | * | 12/1985 | Aoyama | 473/379 |
| 4,765,626 | A | * | 8/1988 | Gobush | 473/383 |
| 4,979,747 | A | * | 12/1990 | Jonkouski | 473/377 |
| 4,991,852 | A | * | 2/1991 | Pattison | 473/379 |
| 5,024,444 | A | * | 6/1991 | Yamagishi et al. | 473/371 |
| 5,368,304 | A | * | 11/1994 | Sullivan et al. | 473/377 |

FOREIGN PATENT DOCUMENTS

| | | | | |
|---|---|---|---|---|
| EP | 0605079 | * | 8/1993 | A63B/37/14 |

* cited by examiner

*Primary Examiner*—Mark S. Graham
*Assistant Examiner*—Raeann Gorden
(74) *Attorney, Agent, or Firm*—Lorusso Loud & Kelly LLP

(57) ABSTRACT

A two piece golf ball has a core compression in the range of 77 PGA to 87 PGA, a core diameter in the range of about 1.532 inches to 1.548 inches, a cover hardness in the range of 66 to 72 Shore D, and a dimple pattern based on the geometry of a truncated octahedron. A ball having such characteristics exhibits superior distance performance without compromising shot-making feel.

11 Claims, 10 Drawing Sheets

TWO PIECE DISTANCE GOLF BALL

CROSS-REFERENCE TO RELATED APPLICATION

A claim of benefit is made to U.S. Provisional Application Ser. No. 60/092,477, filed Jul. 10, 1998, the contents of which are incorporated herein by reference.

BACKGROUND OF THE INVENTION

The present invention is directed to golf balls, and more particularly to a ball having the optimal core compression, core diameter, cover hardness, and dimple configuration to provide superior distance capabilities.

DESCRIPTION OF THE PRIOR ART

It is well known in the golf industry that the distance a ball travels is one of the key features that distinguishes one ball from the next. In the golf ball business, distance sells.

Ball manufacturers are bound by regulations of the United States Golf Association (USGA) which control many characteristics of the ball, including the size and weight of the ball, the initial velocity of the ball when tested under specified conditions, the overall distance the ball travels when hit under specified test conditions, and the ball's aerodynamic symmetry. Under USGA regulations, the diameter of the ball cannot be less than 1.680 inches, the weight of the ball cannot be greater than 1.620 ounces avoirdupois, the initial velocity of the ball cannot be greater than 250 feet per second when tested under specified conditions (with a maximum tolerance of +2%), the driver distance cannot exceed 280 yards when tested under specified conditions (with a test tolerance of +6%), and the ball must be spherically symmetric in an aerodynamic sense.

While the USGA sets a limit for the distance a ball can travel under set test conditions, there is no upper limit on how far a player can hit a ball. In the effort to design a ball with superior distance capabilities, one area that ball manufacturers have looked to is dimple configurations. For example, U.S. Pat. No. 4,886,277 discloses the projection of a truncated octahedron onto the ball as a basis for a dimple configuration. A truncated octahedron is formed by removing portions of the eight sided octahedron which results in a solid with six (6) squares and eight (8) hexagons. The preferred ball disclosed in this reference has a minimum of four (4) uninterrupted great circle paths present on the dimpled ball, and a major portion of the dimples present on the ball are within the boundaries of either a spherical hexagon or square. U.S. Pat. No. 4,765,626 discloses a golf ball having a dimple pattern based on the truncated octahedron used in conjunction three orthogonal uninterrupted parting lines which coincide with the diagonal bisectors of the squares.

A problem with the prior art dimple configurations is that they fail to take into account other features of the ball, such as core size, core compression and cover hardness, which also influence how far a ball will travel.

U.S. Pat. No. 5,368,304 to Sullivan discloses a ball having a low spin rate, which in turn enables the ball to travel greater distances. According to the Sullivan patent, the low spin rate is the result of a soft core and hard cover. While the '304 patent discloses the use of a soft core and hard cover to lower the spin rate, it does not disclose a dimple configuration for the ball.

There is a need to develop a superior distance ball that takes into account not only the dimple configuration, but also the core compression, core diameter and cover hardness.

OBJECTS OF THE INVENTION

It is an object of the present invention to provide a golf ball which has superior distance capabilities.

It is another object of the present invention to optimize the combination of core compression, core size, dimple configuration and cover hardness to provide a golf ball which travels great distances, and at the same time complies with USGA regulations.

SUMMARY OF THE INVENTION

The golf ball of the present invention is based on the recognition that it is the combination of the dimple configuration, dimple size, dimple shape, core compression, core size, and cover hardness that produces a ball that will travel the greatest distance.

The ball of the present invention has a core compression in the range of 77 PGA to 87 PGA; a core diameter in the range of about 1.532 inches to about 1.548 inches; a cover hardness in the range of about 66 Shore D to about 72 Shore D; and a dimple pattern based on the geometry of a truncated octahedron. This combination has been found to produce a ball with superior distance capabilities which also satisfies USGA regulations.

The dimples are arranged on the surface of the golf ball based on the geometry of a truncated octahedron. A truncated octahedron is formed by, as the name implies, removing portions of an eight sided octahedron. This removal results in a solid with six (6) squares and eight (8) hexagons. This solid is projected onto the surface of the golf ball so that the two opposing poles of the golf ball coincide with the centers of two opposing hexagons. This projection defines an equatorial great circle path which is then utilized as the mold parting line for the golf ball. This mold parting line, as typical with most golf balls, will not be intersected by any dimples. Dimples may, however, intersect any or all projected sides of any polygonal structures, so long as this intersection is performed in a symmetrical fashion over the entire surface of the golf ball. It is preferred, but not required, that if any such intersection exist, the dimples are equally divided for the most part by any of the intersecting lines.

The present invention is flexible in that it is not as restricted in the placement of dimples as the prior art balls, and therefore utilizes the natural symmetry of the solid more effectively.

The core has a compression of 77 to 87 PGA, and a diameter of 1.532 inches to 1.548 inches. The cover has a hardness of about 66 Shore D to about 72 Shore D.

DETAILED DESCRIPTION OF THE DRAWINGS

DETAILED DESCRIPTION OF THE INVENTION

Figure 1:
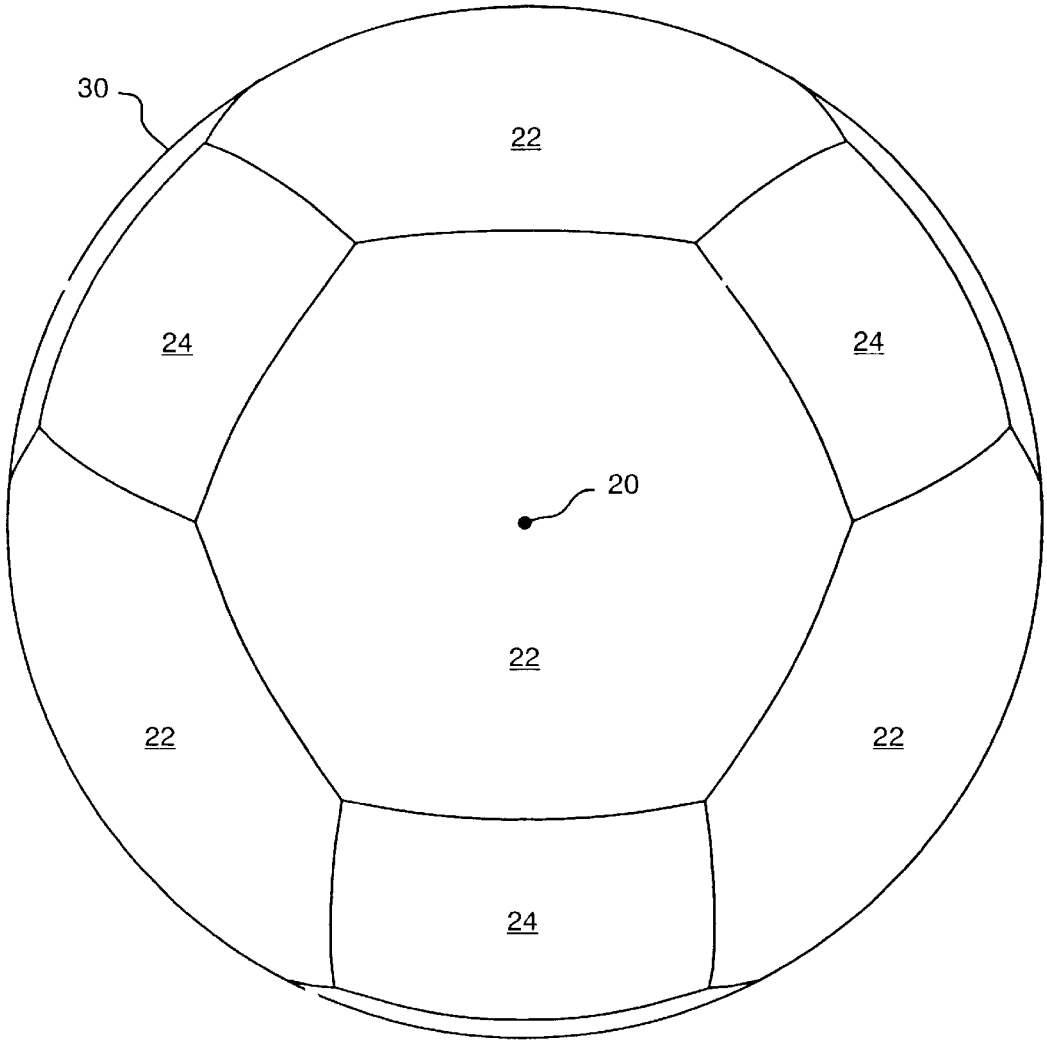
FIG. 1 shows a polar view of one embodiment of the present invention, with a truncated octahedron projected onto the surface of the golf ball.

FIG. 1 shows a polar view of one embodiment of the present invention. A truncated octahedron is shown with eight (8) identical regular hexagons 22, and six (6) identical squares 24, with opposing spherical hexagons centered on the poles of the golf ball 20. The equatorial great circle path is shown at 30.

Figure 2:
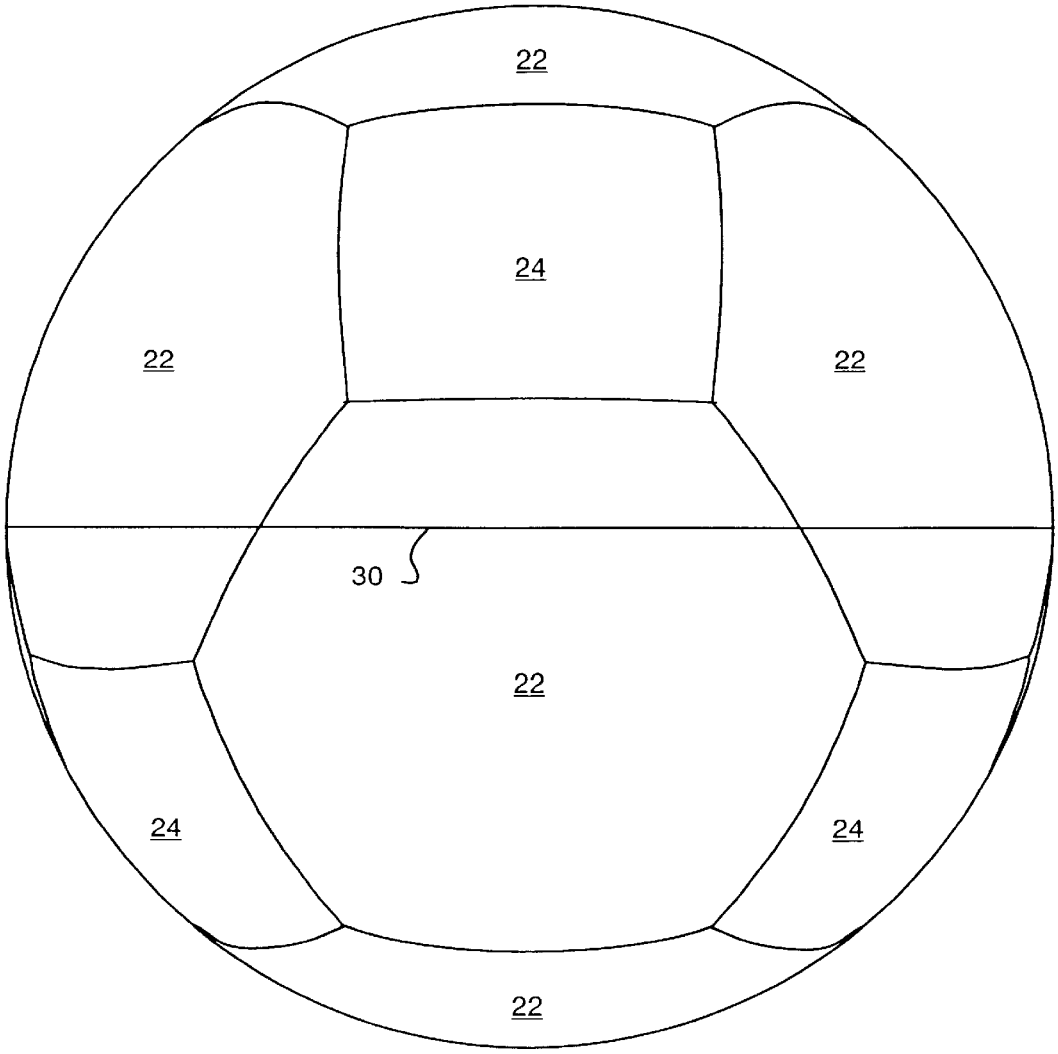
FIG. 2 shows an equatorial view of the golf ball of FIG. 1.

FIG. 2 shows the equatorial view of the surface of the ball of FIG. 1. The equatorial great circle path 30 bisects two alternative sides of the equatorial hexagons.

Figure 3:
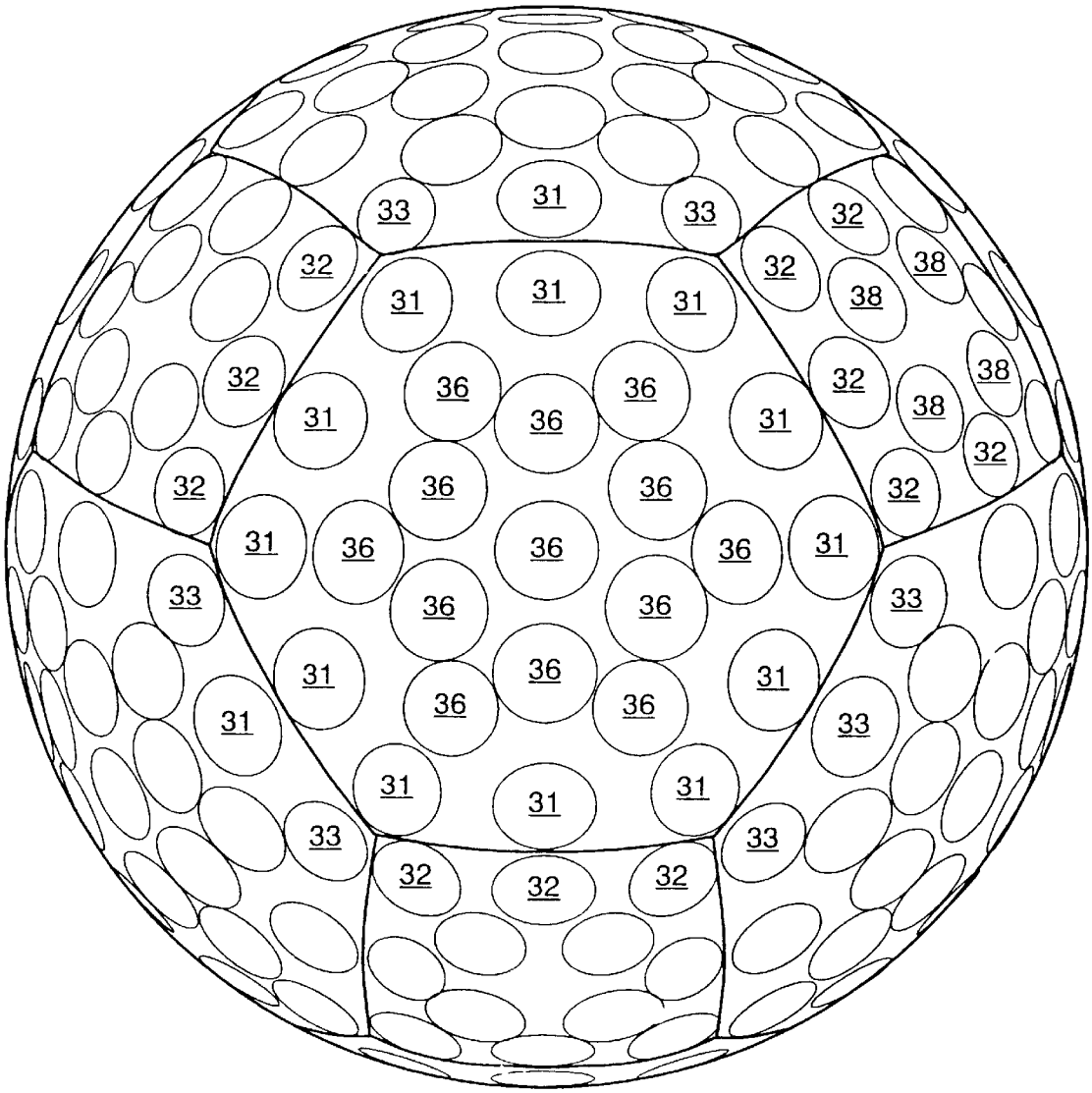
FIG. 3 shows a polar view of another embodiment of the present invention in which the dimples are not intersected by any defining lines.

FIG. 3 shows a polar view of the dimple placement of one embodiment using the truncated octahedron of FIG. 1. No dimples are intersected by the defining lines or by the equatorial great circle path 30. This can be seen by the placement of affected dimples 31, 32 and 33. In this embodiment, there are three sizes of dimples, 36 and 31 being essentially the same size, and being larger than 33, which is larger than 32 and 38 which are essentially the same size.

Figure 8:
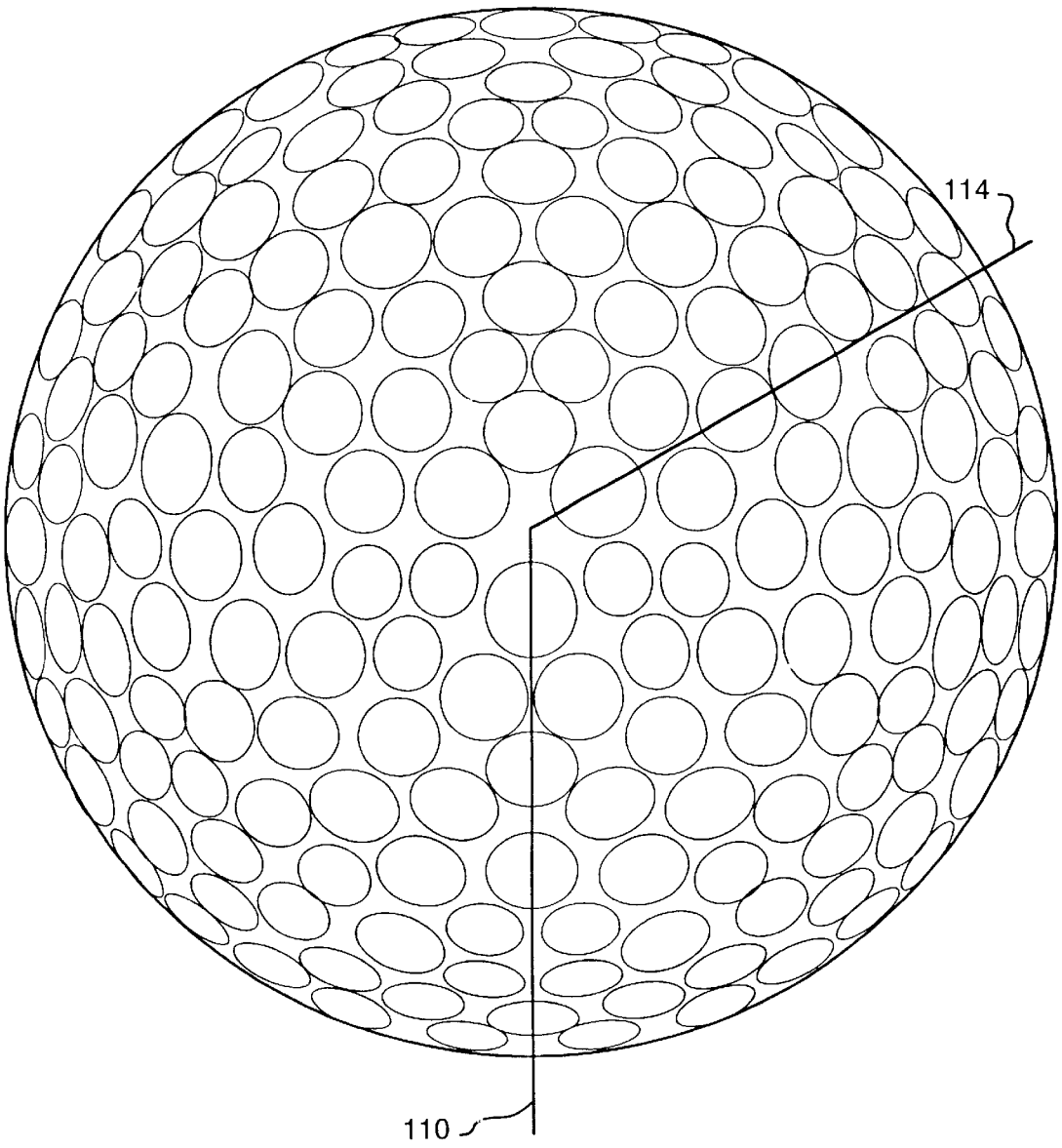
FIG. 8 shows a polar view of another embodiment of the present invention.
Figure 9:
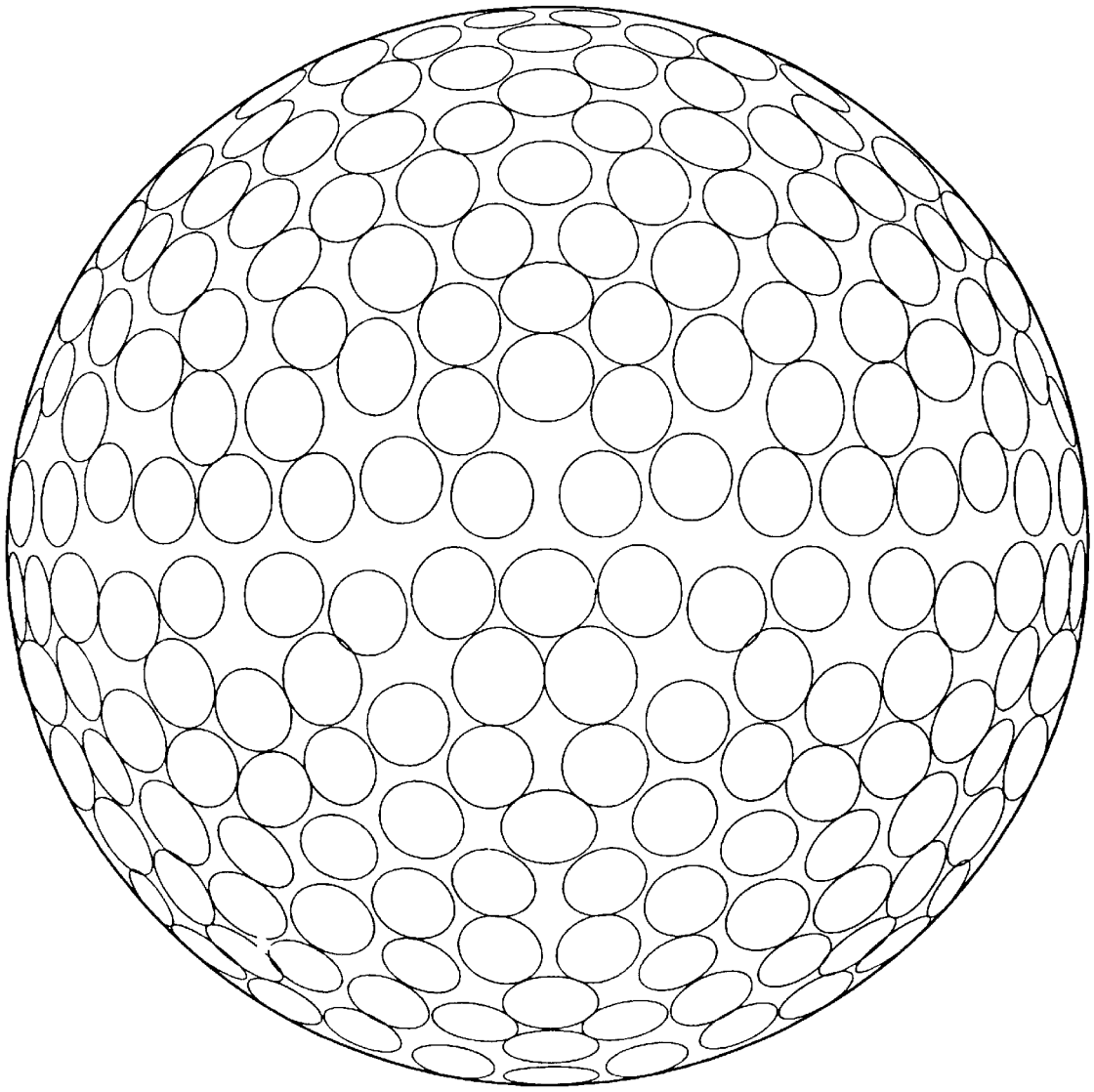
FIG. 9 shows an equatorial view of the golf ball of FIG. 8.

FIG. 8 shows the polar view of the preferred embodiment and FIG. 9 shows an equatorial view of that embodiment. There are 408 dimples in this embodiment of essentially three sizes. The dimples range from 0.160 inches to 0.110 inches in diameter with depths between 0.0050 inches to 0.0085 inches. Preferably, dimple sizes utilized are 0.1580 inches, 0.1440 inches and 0.1200 inches. The preferred dimple depth is 0.0060 inches. Dimple depth and diameter are measured according to the teachings of U.S. Pat. No. 4,936,587. It is understood that the depths are measured from the chord, rather than the continuation of the periphery of the surface of the sphere. It is to be further understood that any dimple dimensions referenced herein refer to dimple size on an unfinished ball as it is removed from a mold as opposed to a painted or finished golf ball.

The pattern shown in the area defined by lines 110 and 114 on FIG. 8 repeats itself in each of the remaining five sixths of the ball.

Figure 10:
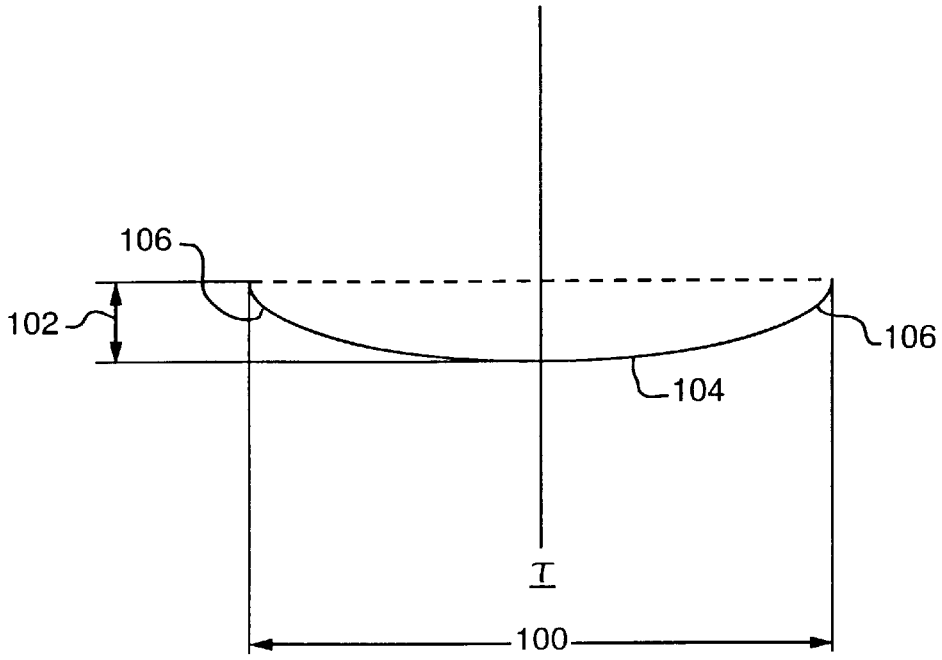
FIG. 10 shows a cross section of a dimple.

FIG. 10 shows a cross section of a dimple having a diameter 100, a depth 102, a major radius 104, and a minor radius 106. The major radius 104 governs the shape of the dimple toward the bottom of the dimple, while the minor radius 106 governs the shape of the dimple about its circumference.

Figure 4:
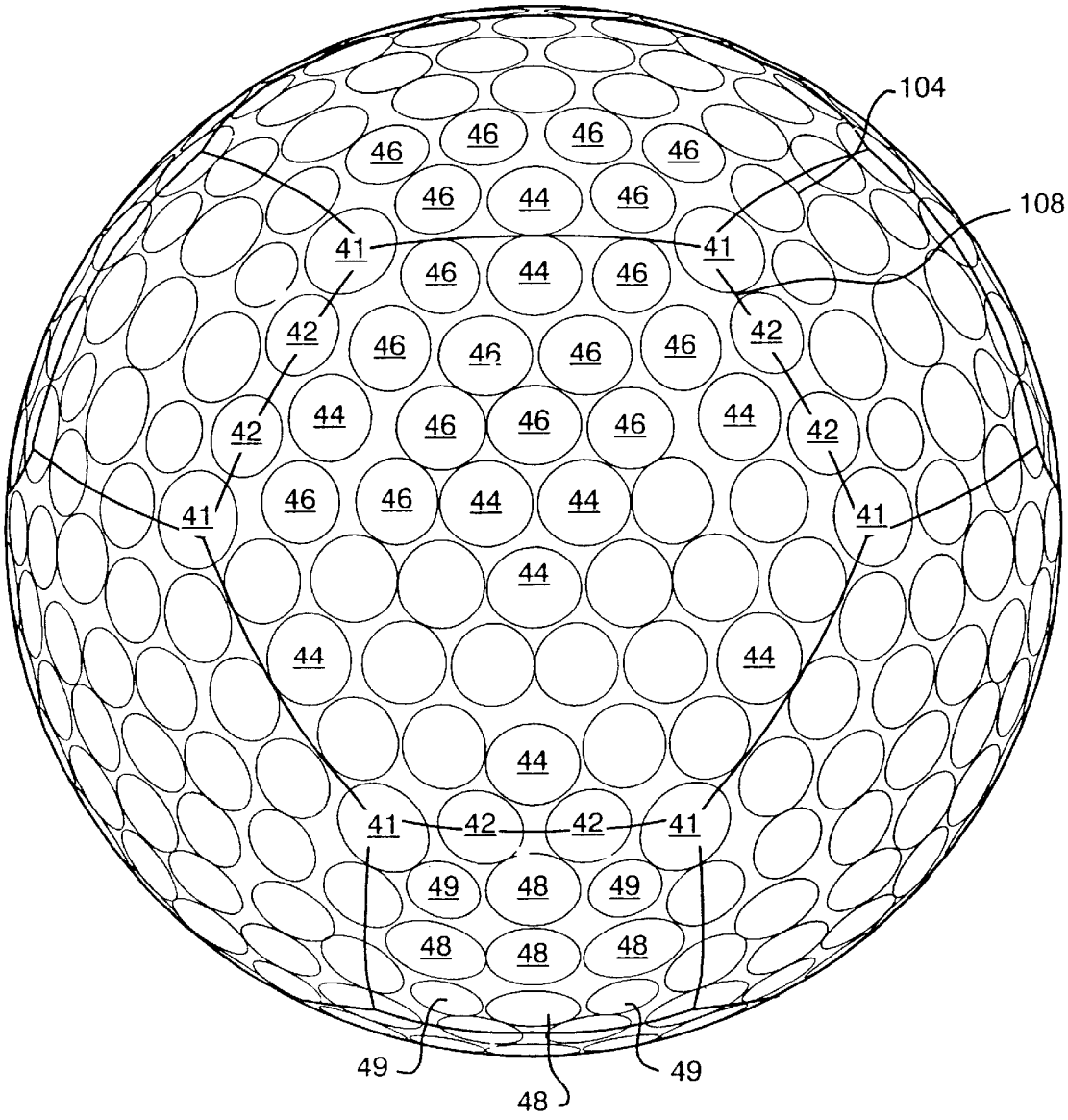
FIG. 4 shows a polar view of another embodiment of the present invention in which the dimples are essentially bisected by defining lines.
Figure 5:
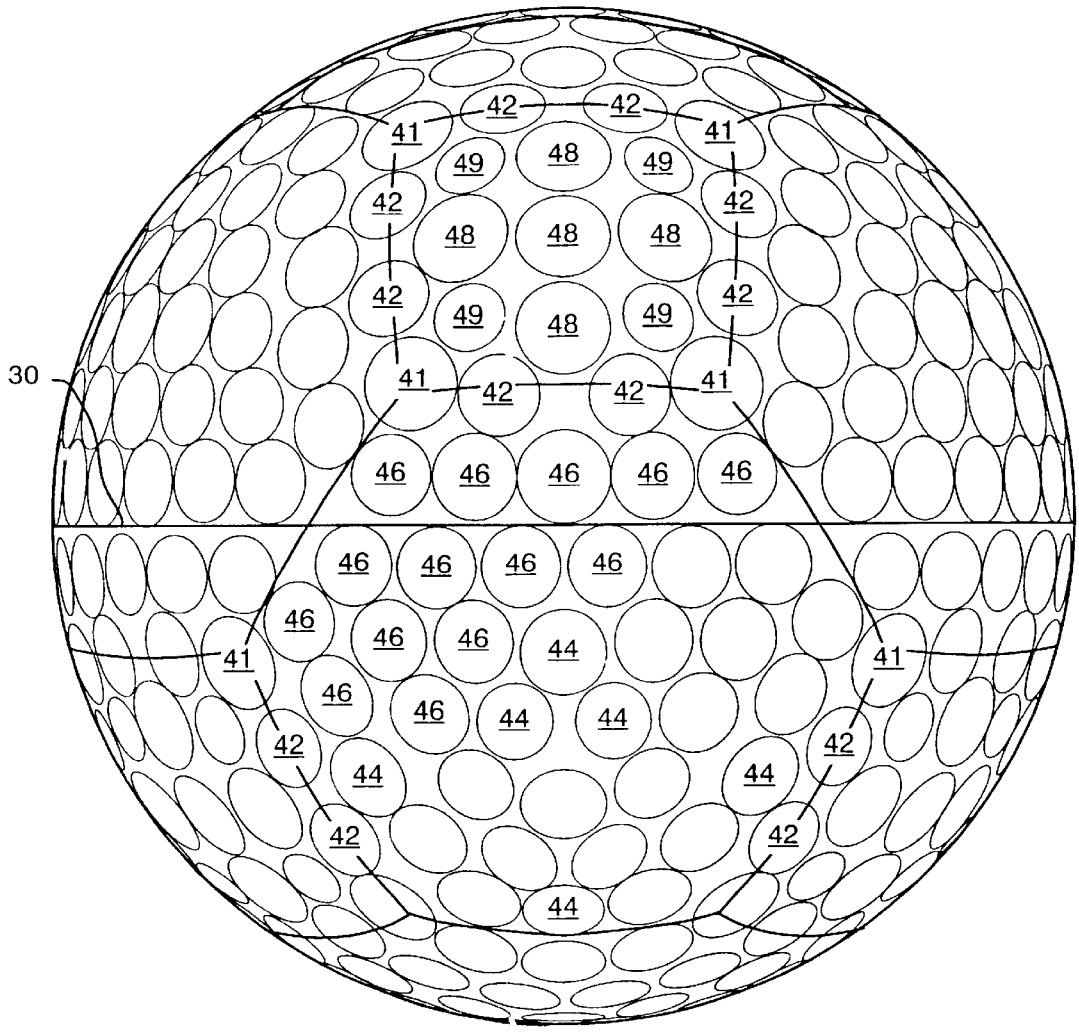
FIG. 5 shows an equatorial view of the golf ball of FIG. 4.

FIG. 4 is a polar view of the dimple pattern of another embodiment of the present invention using the truncated octahedron as set forth in FIG. 1. In this embodiment, dimples 41 and 42 are essentially divided into equal parts by the defining lines 104 and 108. There are four sizes of dimples, 41 and 48 being essentially the same size and being larger than 44 which is larger than 46 and 42 which are essentially the same size and which are larger than 49. FIG. 5 shows the equatorial view of the ball shown in FIG. 4.

Figure 6:
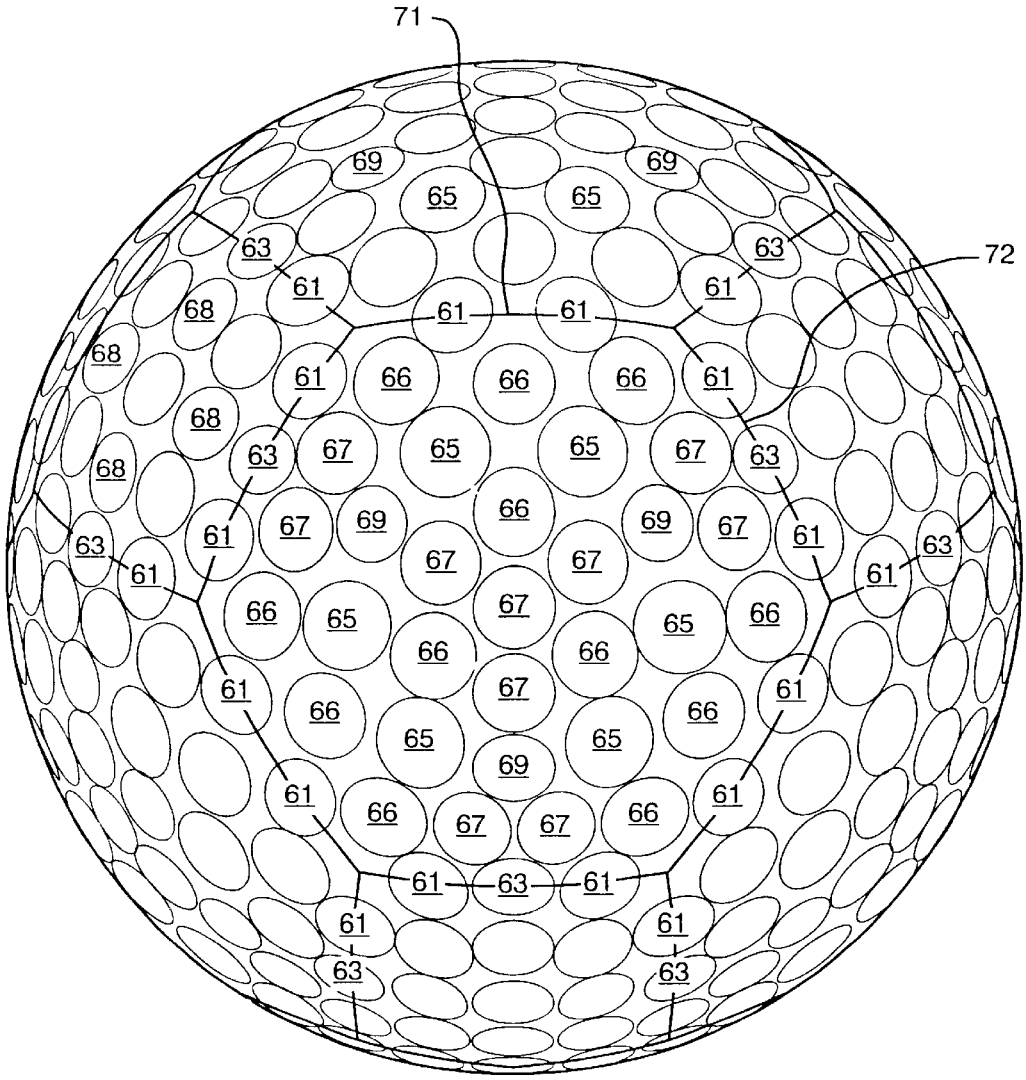
FIG. 6 shows a polar view of another embodiment of the present invention in which the dimples are essentially bisected by defining lines.
Figure 7:
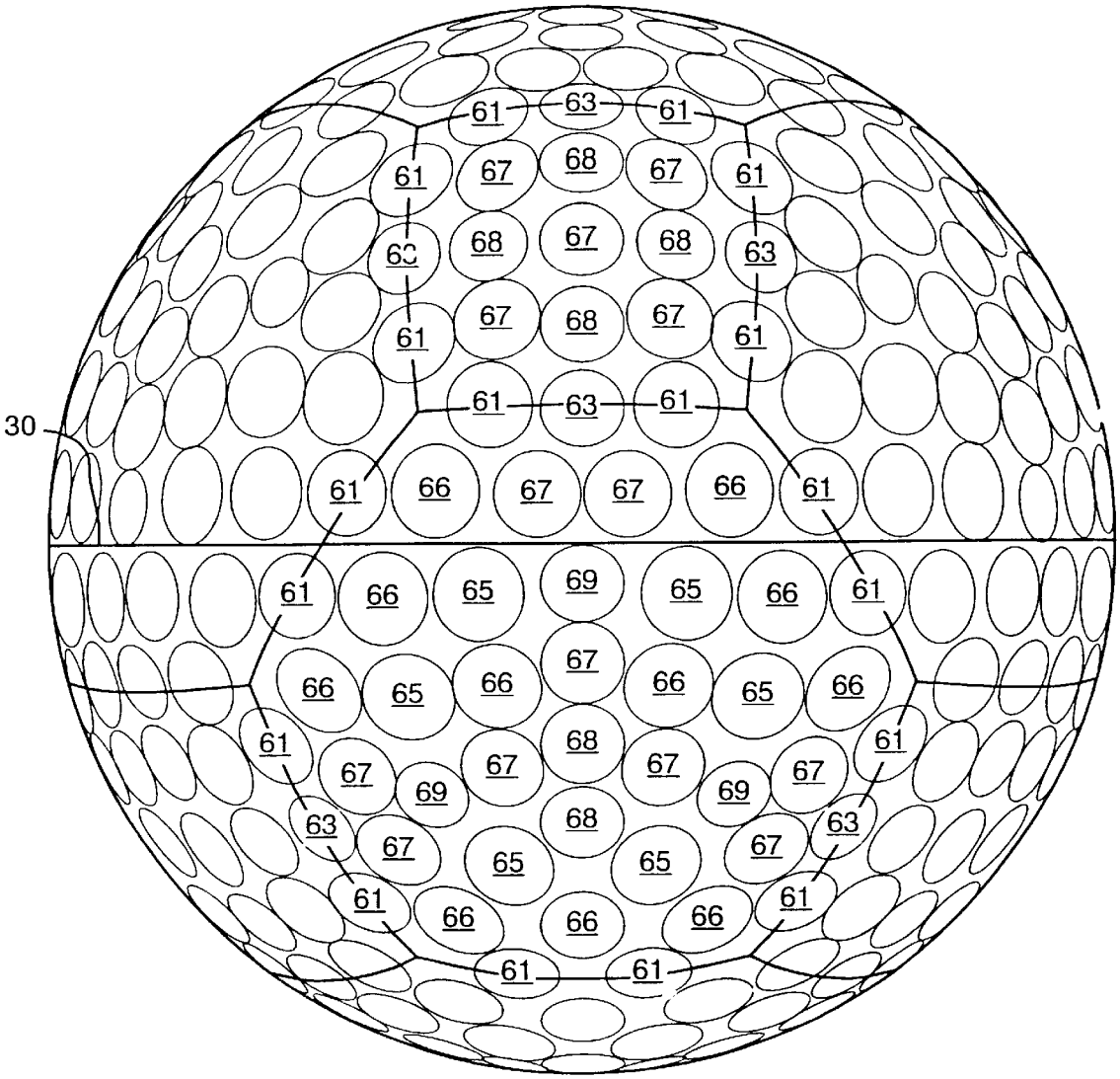
FIG. 7 shows an equatorial view of the golf ball of FIG. 6.

FIG. 6 shows another embodiment of the present invention in which the dimples are placed in accordance with the structure of FIG. 1. In this embodiment all defining lines essentially bisect at least two dimples. It is seen that defining lines 71 shaped by two hexagons, bisect dimples 61 while defining lines 72 shared by a hexagon and a square bisect dimples 61 and 63. This embodiment incorporates dimples of five sizes. Dimples 65 are larger than 66 which are larger than 67 and 61 which are essentially the same size and are larger than 68 which is larger than 69 and 63 which are essentially the same size. FIG. 7 shows the equatorial view of ball shown in FIG. 6, with the equatorial great circle path 30. It can by seen that the defining lines bisected by the equator, still bisect dimples 61.

Turning to the core composition, as previously stated, it has been determined that golf ball travel distance is optimized when the foregoing dimple patterns are combined with a core having a compression of about between 77 and 87 PGA, nominal. Core compression is determined by applying a 200 lb. load to the core and measuring the deformation that results. To prepare such a core, it has been found that a core composed primarily of high-cis polybutadiene in combination with cross-linking agents, activators, initiators and fillers (active and inactive), can be used to achieve a golf ball core having the desired compression characteristics.

As is well known in the art, the type and amount of crosslinking agents used to make the core will have the greatest influence on the core compression achieved. In one embodiment, a compression of about between 77 and 87 PGA, nominal, is achieved by preparing a compound consisting of, by parts per hundred parts rubber polymer (PHR), by weight 90–100 PHR high-cis polybutadiene, 0–10 PHR natural or polyisoprene rubber, 25–30 PHR Zinc Diacrylate, 3–6 PHR Zinc Oxide, 15–24 PHR of fillers and process aids, 0–1 PHR of antioxidant, and 0–5 PHR of a free radical initiator or peroxide. As used herein, high-cis means a cis isomer content of greater than 93%. It is to be understood that the core formula set forth herein is but one formula that can be used to make a core having the desired core compression.

The listed components are dry mixed in a mixer such as a Banbury mixer. The mixed ingredients are then "sheeted" on a drop mill and extruded to desired weight and dimensions.

The extruded plugs are then placed in mold cavities where heat and pressure are applied. In one embodiment, the plugs are heated from about between 135° C. and 175° C. under sufficient pressure to maintain the plug within the mold cavity. The plugs are maintained in the cavities under the requisite heat and pressure until cured. Curing takes place under the designated temperatures when the plugs are maintained under pressure in the cavities for about between 5 minutes to 25 minutes. Once fully cured, the cores are removed from the mold cavities and prepared for application of a cover.

As set forth above, another key component of the invention is the cover hardness. Cover hardness is measured with a Shore D Durometer made by Shore Instrument and Mfg. Co., Inc., by employing ASTM method D-2240-91, "Indentation Hardness of Rubber and Plastic by Means of a Durometer," as applied on a complete golf ball on the land area, i.e., between dimples. To achieve the desired Shore D hardness of about between 66 to 72, a number of cover materials and blends can be used. A number of compositions including ionomer-based and polyurethane-based compositions can be used so long as the key hardness feature is achieved. For example, an ionomer or ionomer blend based on materials such as Surlyn™ (E.I. Dupont), can be used.

In one embodiment, a blend of, by weight of the total weight of the cover composition, 20–60% Surlyn™8150 and 40–80% Surlyn™9150 can be combined to produce an overall cover hardness of 70 Shore D.

In another embodiment, a blend of 30–60% Surlyn™ 9150, 15–45% Surlyn™8150 and 10–40% Surlyn™6910 can be blended to achieve a cover hardness of 68 Shore D. Other cover materials such as polyurethane-based compositions can also be used provided that the desired cover hardness is achieved.

To make the cover, the blended components of the cover are injection molded into cavities which contain cores suspended in the center of the cavities. The inner surfaces of the cavities are constructed with dimple-shaped projections which form the dimples in the cover. The process used to make the cover is the standard process used and well known in the art wherein one or more components are added together to form a blend which is then injected into the mold.

Golf balls made in accordance with the invention have exhibited superior distance travel when struck with an automated golf club swinging machine as compared to conventional golf balls. Improvements were realized in carry distance, roll distance and overall travel distance regardless whether a driver or iron were used to strike the golf balls.

While the invention has been particularly shown and described with reference to the aforementioned embodiments, it will be understood by those skilled in the art that various changes in form, composition and detail may be made therein without departing from the spirit and scope of the invention. Thus, any modification to the shape, configuration and/or composition of the elements comprising the invention is within the scope of the present invention.

Having thus described our invention, what we claim as new and desire to secure by United States Letters Patent is:

What is claimed is:

1. A golf ball comprising:

a core having a compression in the range of about 77 PGA to about 87 PGA;

a cover having a Shore D hardness in the range of about 66 Shore D to about 72 Shore D; and, a single equatorial great circle path free of dimples, wherein said great circle path is formed by a mold parting line;

a surface having a series of polygonal configurations projected thereon and a plurality of dimples arranged in said polygonal configurations wherein said single equatorial great circle path bisects said polygonal configurations into non-symmetrical portions wherein said non-symmetrical portions are truncated octahedrons.

2. The golf ball of claim 1 wherein the single equatorial great circle is not intersected by any dimples.

3. The golf ball of claim 1 wherein at least one dimple is intersected by at least one side of the truncated octahedron.

4. The golf ball of claim 3 wherein the at least one dimple intersected by the at least one side of the truncated octahedron is essentially bisected by the side of the truncated octahedron.

5. The golf ball of claim 1 wherein the core has a diameter in the range of about 1.532 inches to about 1.548 inches.

6. The golf ball of claim 1 wherein said dimples have diameters in a range of about 0.160 to 0.110 inches.

7. The golf ball of claim 6 wherein said dimples have depths in a range of about 0.0050 to 0.0085.

8. The golf ball of claim 6 wherein said dimples have a depth of 0.0060 inches.

9. The golf ball of claim 1 wherein said dimples have depths in a range of about 0.0050 to 0.0085.

10. The golf ball of claim 1 wherein said dimples have a depth of 0.0060 inches.

11. The golf ball of claim 1 wherein said dimples comprise 408 dimples.

* * * * *